US007490618B2

(12) United States Patent
DeMay et al.

(10) Patent No.: US 7,490,618 B2
(45) Date of Patent: Feb. 17, 2009

(54) FOREARM CRUTCH PADDED COVER

(75) Inventors: Shirley DeMay, St. Louis, MO (US); Neil Westbrooks, St. Louis, MO (US)

(73) Assignee: DeMay Med, LLC Mo. Corp., St. Louis, MO (US)

( * ) Notice: Subject to any disclaimer, the term of this patent is extended or adjusted under 35 U.S.C. 154(b) by 187 days.

(21) Appl. No.: 11/701,782

(22) Filed: Feb. 2, 2007

(65) Prior Publication Data

US 2007/0131264 A1 Jun. 14, 2007

Related U.S. Application Data

(63) Continuation-in-part of application No. 10/928,901, filed on Aug. 27, 2004, now Pat. No. 7,204,262.

(51) Int. Cl.
*A61H 3/02* (2006.01)

(52) U.S. Cl. ..... 135/68; 135/71; 135/72; 150/154; 482/67; 482/75; 128/878

(58) Field of Classification Search ..... 135/65, 135/68, 71–73, 907; 128/877–878; 150/154, 150/160; 602/19–23, 62; 482/66–67, 75–76
See application file for complete search history.

(56) References Cited

U.S. PATENT DOCUMENTS

| | | | | | |
|---|---|---|---|---|---|
| 3,626,519 | A | * | 12/1971 | Baker | 623/28 |
| D258,096 | S | * | 2/1981 | Barfod | D3/8 |
| 4,248,256 | A | * | 2/1981 | Thomas | 135/67 |
| 4,510,928 | A | * | 4/1985 | Ackley | 602/4 |
| 4,834,366 | A | * | 5/1989 | Hotchkiss | 482/122 |
| 4,858,267 | A | * | 8/1989 | Unger | 15/220.1 |
| 4,869,280 | A | * | 9/1989 | Ewing | 135/69 |
| 5,101,846 | A | * | 4/1992 | Greatwood | 135/73 |
| 5,284,194 | A | * | 2/1994 | Gaffney | 150/160 |
| 5,329,954 | A | * | 7/1994 | Miyoshi | 135/71 |
| 5,645,515 | A | * | 7/1997 | Armstrong et al. | 482/75 |
| 5,904,167 | A | * | 5/1999 | Moye | 135/65 |
| 6,085,765 | A | * | 7/2000 | Sigsworth | 135/68 |
| 6,129,693 | A | | 10/2000 | Peterson | 602/32 |

FOREIGN PATENT DOCUMENTS

| | | | |
|---|---|---|---|
| DE | 4340424 | A1 * | 6/1995 |
| DE | 19624414 | A1 * | 1/1998 |
| DE | 102004015198 | A1 * | 5/2005 |

* cited by examiner

*Primary Examiner*—Winnie Yip
(74) *Attorney, Agent, or Firm*—Paul M. Denk

(57) ABSTRACT

A forearm crutch cover that provides padding in the forearm cradle to increase the comfort of the user and covers the pivoting attachment junction that attaches the forearm cradle to the pole of the forearm crutch to help prevent injury or damage caused at the pivoting attachment junction when the forearm cradle is moved. The cover may also include a forearm strap to prevent the cradle from slipping off the arm. An elastic tongue may act as a reset for cradle to prevent the cradle from falling downward and allows easy access to the cradle for the user.

25 Claims, 7 Drawing Sheets

FOREARM CRUTCH PADDED COVER

CROSS REFERENCE TO RELATED APPLICATIONS

This application is a continuation-in-part patent application of U.S. application having Ser. No. 10/928,901 filed on Aug. 27, 2004 now U.S. Pat. No. 7,204,262 and also claims priority to the PCT patent application No. PCT/US2006/004997 filed on Feb. 14, 2006.

BACKGROUND OF INVENTION

This invention relates generally to padded cane or crutch coverings and cushions. More specifically, this invention relates to a padded cover or cushion for a forearm cane or crutch. A typical forearm cane or crutch consists of an adjustable length pole with a forearm cradle pivotally attached at or near the top of the pole. The cane or crutch is typically made of metal or some other sturdy material for support and durability.

During normal activities, the user can develop sores on the forearm due to pressure or pinching of the arm in the forearm cradle. In addition, the junction where the forearm cradle attaches to the crutch pole can often create discomfort and pain. For example, the user may pinch his arm between the forearm cradle and pole as the forearm cradle pivots at its hinge through a range of positions. The attachment junction can also pinch or catch on materials near it and cause damage to clothing, coats, upholstery or other materials it contacts. Further, the attachment junction can scratch or mar walls, doors, trim, furniture, vehicles or the like.

Holding a forearm crutch limits the availability of the user's hands for everyday tasks and creates safety issues for the user. For example, the user may let go of one crutch hand grip and transfer the crutch to the other hand in order to open a door. The user must open the door, hold it open and walk through the doorway while maintaining control over the free crutch. All of this activity is done while the user is balancing on the remaining crutch. If the user drops the free crutch, he must bend down and pick it up while balancing on the remaining crutch. Another similar problem occurs when pushing a shopping cart. While the user use the shopping cart to help balance while walking on one crutch, any movement away from the cart to remove anitem from the shelf requires balancing on one crutch and creates a safety concern for the user.

What is needed, therefore, is a forearm cane or crutch covering or cushioning that makes the crutch more comfortable for the user while at the same time it helps protect the user and his surroundings from injury or damage related to relative movement between the forearm cradle and the pole on which it is mounted or injury resulting from the need to let go of the hand grip and perform everyday tasks.

It is an object of this invention to make the forearm cradle of a forearm cane or crutch more comfortable and to minimize or eliminate pinching, scratching or other damage caused by the pivotable connection of the forearm cradle to the pole.

It is feature of this invention that the forearm cane or crutch cover will fit the forearm cane or crutch when it is adjusted to fit the height and arm length of a user.

It is another feature of the invention to make it more comfortable and to make it easier to control the operation of a cane or crutch.

It is another feature of the invention to make it safer to for user to let go of the crutch and use his hand, by preventing the crutch from slipping off the forearm when the user lets go of the handgrip.

It is yet another feature of the invention to make it possible to apply the teachings of the present invention to known canes or crutches to increase their comfort and to make them better able to be used.

Another feature of the invention is to make better use of commercially available canes and crutches.

Still other objects, advantages, distinctions and alternative constructions and/or combinations of the invention will become more apparent from the following description with respect to the appended drawings. Similar components and assemblies are referred to in the various drawings with similar alphanumeric reference characters. This description should not be literally construed in limitation of the invention. Rather, the invention should be interpreted within the broad scope of the further appended claims.

SUMMARY OF THE INVENTION

The present invention is directed to a forearm cane cover or cushion or a forearm crutch cover or cushion that makes the forearm cradle more comfortable for the user and helps prevent injury or damage caused by contact with the sharp edges of the pivoting attachment junction and by the resultant gap created and closed between the forearm cradle and pole when the forearm cradle pivots around the pole of the cane or crutch. In addition, the forearm cane cover will prevent slippage or the forearm cane from the user's arm when the user lets go of the handgrip to use his hands.

The cover may include an at least partially padded covering for the forearm cradle with pieces that may extend from the forearm cradle and may cover at least some portion of the pivoting attachment junction that connects the forearm cradle to the pole. Preferably the cover may provide padding on the inside of the forearm cradle to make the forearm cradle more comfortable to the user. Then extensions from the forearm cradle area may cover the pivoting attachment junction that connects the forearm cradle to the pole. These extensions may essentially enclose the pivoting attachment junction and the gap between the forearm cradle and pole created and closed as the forearm cradle pivots from a backward position to a forward position.

An optional feature of the present device is the use of an expandable portion in the extensions or pieces that cover at least some portion of the pivoting attachment junction. Thus when the forearm cradle pivots through its range of positions, the expansion of the expandable portion may reduce gaping or bunching in the pieces that cover at least some portion of the pivoting attachment. In addition, the expandable portion may allow a forearm crutch cover to fit a forearm crutch when adjusted to various users' heights and arm lengths.

A further significant advantage of the current invention is that the inclusion of a resilient portion that spans between the crutch cover and the crutch pole, particularly when oriented at the front of the crutch, when the cradle is bent rearwardly, as during usage, under pressure of the user, once that pressure is released, the cradle will be pulled back into alignment, and ready for use and application by the invalid, because of the resilience of the expandable portion.

A further advantage of the concept of this invention is the usage and application of the safety strap, that extends from the cradle cover, and which can span across the front opening of the cradle, in order to add to the safety of retention of the invalid's arm therein, during usage and application of the crutch. This provides greater safety during usage of this inventive device.

In addition, other hook and loop straps may extend downwardly from one edge of the cradle cover, extend underneath of the same, and be fastened to the other side of the cover, in order to assure that the cradle cover remains in place, during usage, and can not slip from the crutch during its application.

Another optional feature includes an opening on the front extension of the cover that encompasses the handgrip. This opening may help secure the cover's attachment to the cane or crutch. Alternatively, the crutch cover may include a portion that covers the handgrip of the cane or the crutch. This opening may help secure the cover's attachment to the cane or crutch as well as increase the comfort of the handgrip. It also resets the cradle after usage.

Another preferred embodiment of the forearm crutch cover includes a pleated covering for the hinge, and a height adjustment portion that attaches along the pole extension and attaches the cradle portion of the cover to the handgrip. In adition, this embodiment include a safety strap to help the forearm crutch dangle from the user's arm when the crutch is not in use. The forearm cradle portion may also be made of non-allergenic material and include a permanent or removable breathable pad to help eliminate sores and irritation on the user's arm. If removable, the breathable pad may be disposable or washable for reuse.

DETAILED DESCRIPTION OF THE INVENTION

The apparatus described herein covers the top portion of a forearm cane or crutch to provide a padded forearm cradle and at least a partial enclosure for the pivoting connection junction that attaches the forearm cradle to the pole.

Figures 1, 2:
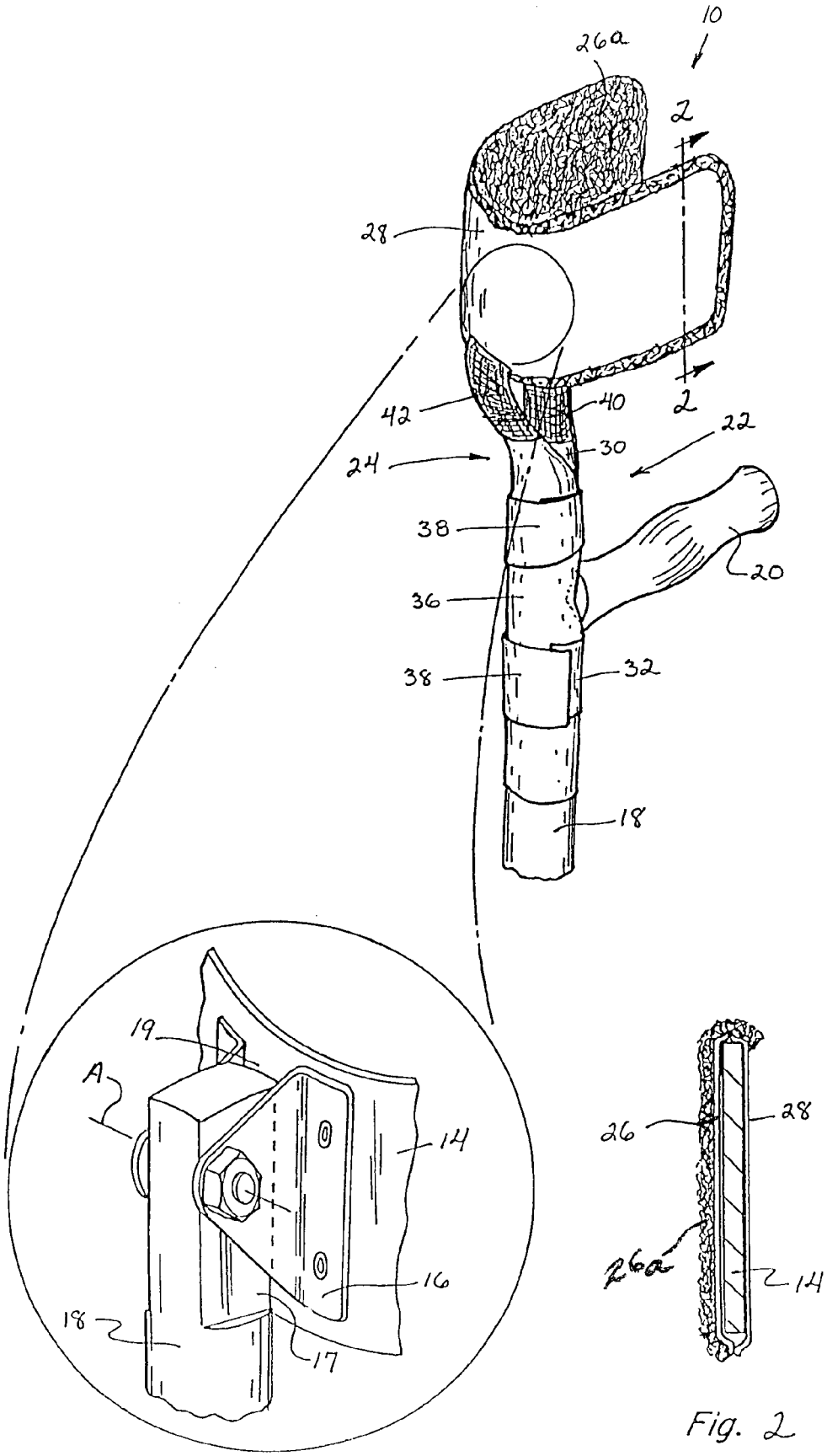
FIG. 1 is a perspective view of a preferred embodiment of the forearm crutch cover as used on a forearm crutch, and a cut away perspective view of the pivoting connection junction that connects the forearm cradle to the pole of the forearm crutch.
FIG. 2 is a cross-sectional view of FIG. 1 taken along the line 2-2.

FIG. 1 depicts a preferred embodiment of a cover 10 for a forearm cane or forearm crutch as shown on a forearm crutch having a forearm cradle 14, a pole 18 and a handgrip 20. The pivoting attachment 16 of the forearm cradle 14 to the pole 18 is shown in the encircled portion of FIG. 1 without the cover 10. This pivoting connection 16, shown as a yoke and bolt attachment in this embodiment, could be a collar and pin joint, a hinge, a swivel, a ball and socket assembly, or the like, depending upon the particular design and construction of the forearm cane or crutch. The pivoting connection 16 allows the forearm cradle 14 to rotate about an axis A through a range of positions. When utilized, the cover 10 may fit over the forearm cradle 14, extend down the pole 18 and may cover at least a portion of the yoke and bolt attachment 16 that pivotally attaches the forearm cradle 14 to the pole 18. The front 22 of the cover 10 may be situated inside the forearm cradle 14 and may extend down the pole 18 towards the sidewardly extending handgrip 20. The back 24 of the cover 10 may be situated around the back or outside of the forearm cradle 14 and may extend down the pole 18 and may cover at least a portion of the yoke and bolt attachment 16 that attaches the forearm cradle 14 to the pole 18.

Figure 3:
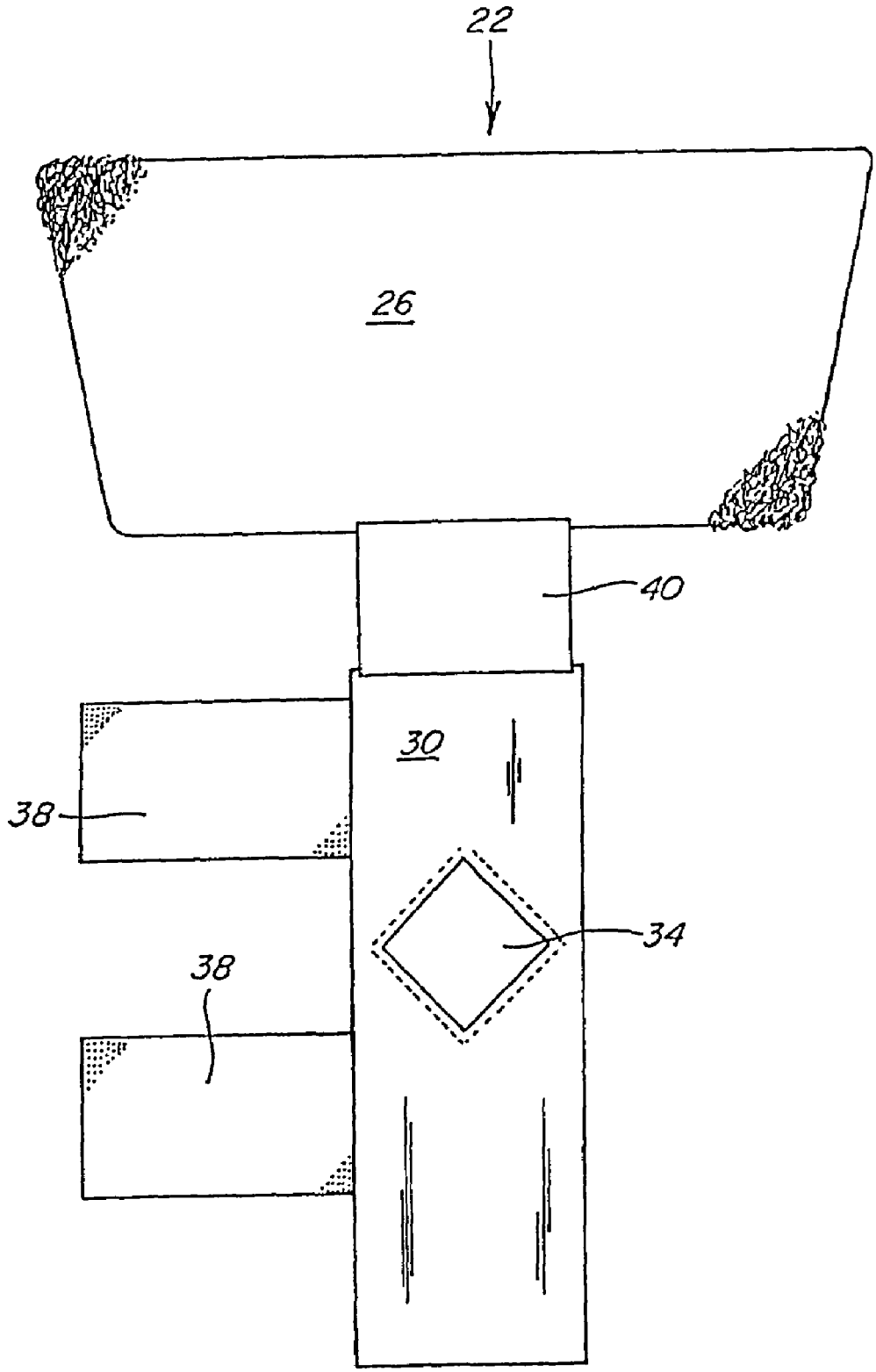
FIG. 3 is a plan view of the preferred embodiment of the forearm crutch cover as seen from the front.
Figure 4:
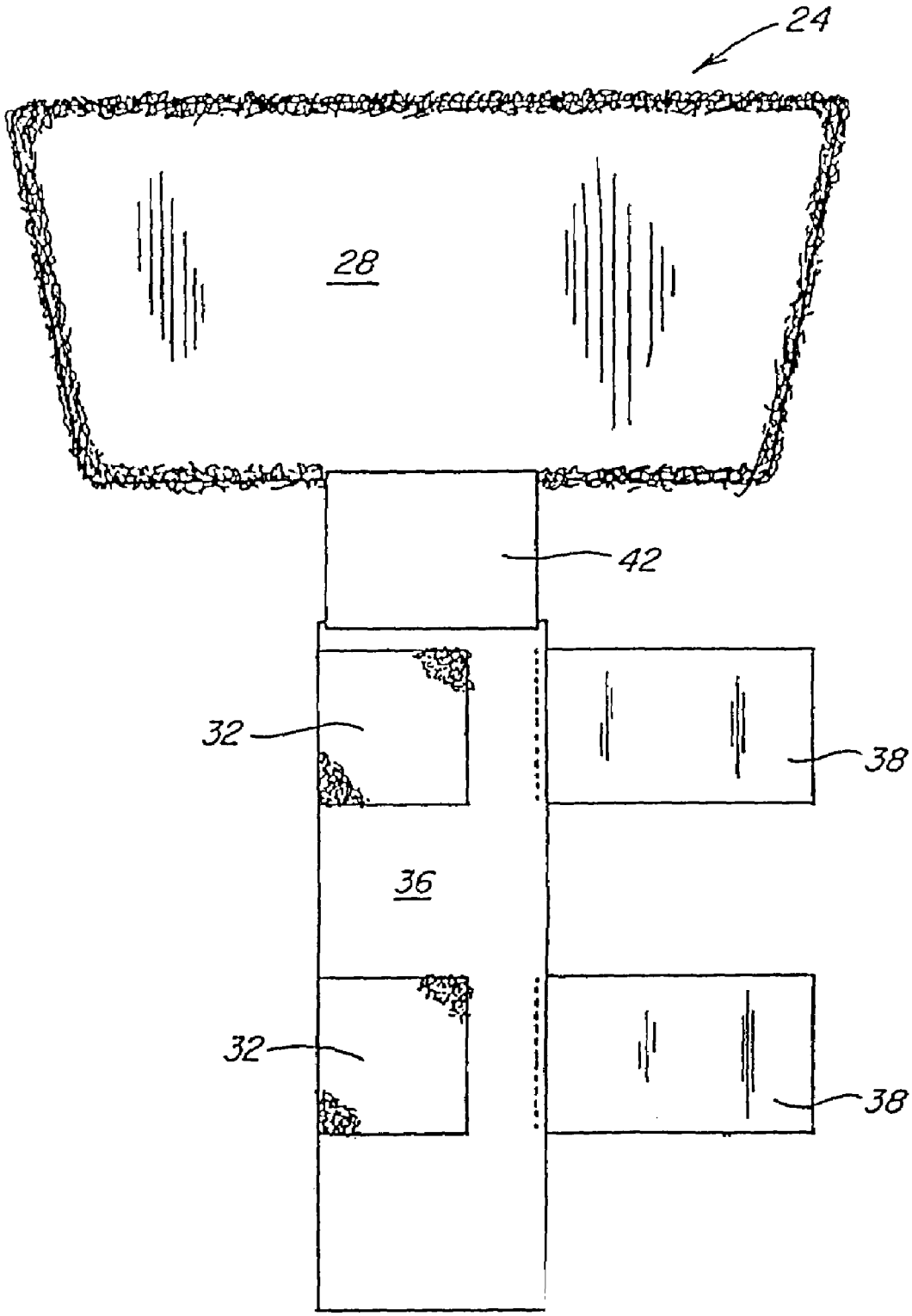
FIG. 4 is a plan view of the preferred embodiment of the forearm crutch cover as seen from the rear.

The forearm cane or crutch cover 10 may be described in four portions—the inner or front forearm cradle portion 26, the outer or back forearm cradle portion 28, the front pole portion 30 and the back pole portion 36 as seen in FIGS. 2, 3 and 4. FIG. 2 is a cross-sectional view of the cover 10 shown in FIG. 1 taken along the line 2-2. The front forearm cradle portion 26 and the back forearm cradle portion 28 are shown on either side of the forearm cradle 14.

The front and back forearm cradle portions 26, 28 may form a flexible covering sized to fit over the U-shaped C-shaped forearm cradle 14. The flexible covering may be constructed in a number of ways that include, but are not limited to, sewing, hook and loop closures, mechanical fasteners, adhesives, or the like. The front and back pole portions 30, 36 may extend from the front and back forearm cradle portions 26, 28. An alternate construction of the cover may include a cushioning material applied directly to the inner or front forearm cradle portion and one or more pole portions may extend from the inner or front forearm cradle portion.

FIG. 3 shows a plan view of the front 22 of the forearm crutch cover 10. The inner or front cradle portion 26 is usually the portion in contact with the user's arm. The padding on the front cradle portion 26 may cushion the user's arm, and it may be made from natural materials or man-made materials, such as soft plastic or rubber, leather, fur or fur-like materials, or the like. The front pole portion 30 may extend from the front forearm cradle portion 26, and it may cover at least some portion of the yoke and bolt attachment 16 that connects the forearm cradle 14 to the pole 18.

FIG. 4 depicts the back 24 of the forearm crutch cover 10. The back forearm cradle portion 28 may cover the back or the outside of the forearm cradle, as at 14. The back cradle portion 28 may be made of natural materials or man-made materials. The back pole portion 36 may extend from the back forearm cradle portion 28, and it may cover at least some portion of the yoke and bolt attachment 16 that connects the forearm cradle 14 to the pole 18. In addition, the back pole portion 36 may have cooperatively engaging elements 32, 38 to help the forearm crutch cover 10 remain on the forearm crutch 12. The cooperatively engaging elements 32, 38 may be, but are not limited to, hook and loop closure as shown in FIG. 4, or any number of methods, such as mechanical fasteners, buckles, slide fasteners, adhesives or the like.

The front pole portion 30 shown in FIG. 3 may include an opening 34 sized to encircle the base of the handgrip 20 that may serve as an additional method to secure the forearm crutch cover 10 to the forearm crutch 12. Alternatively the front pole portion 30 may include a portion that may encase at least some portion of the handgrip 20 that may serve as an additional method to secure the forearm crutch cover 10 to the forearm crutch 12. This covering may provide a better grip for the user and it may be padded to increase the user's comfort.

Figure 6:
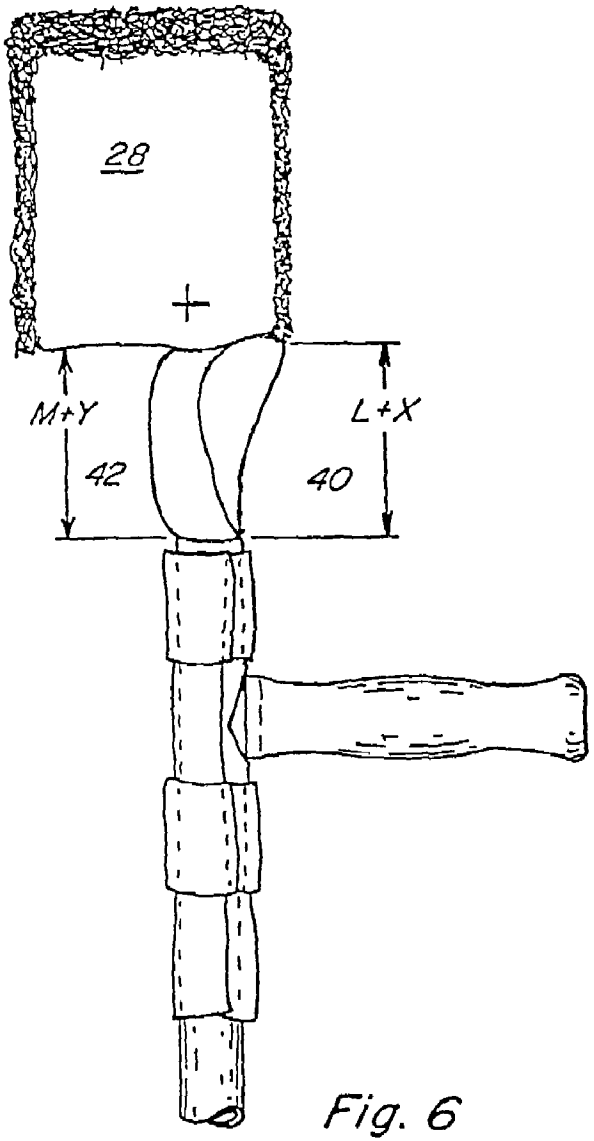
FIG. 6 is a side view of a preferred embodiment of the invention as shown on a forearm crutch with the forearm cradle rotated backward, or in a hands free position typically associated with resting.
Figure 5:
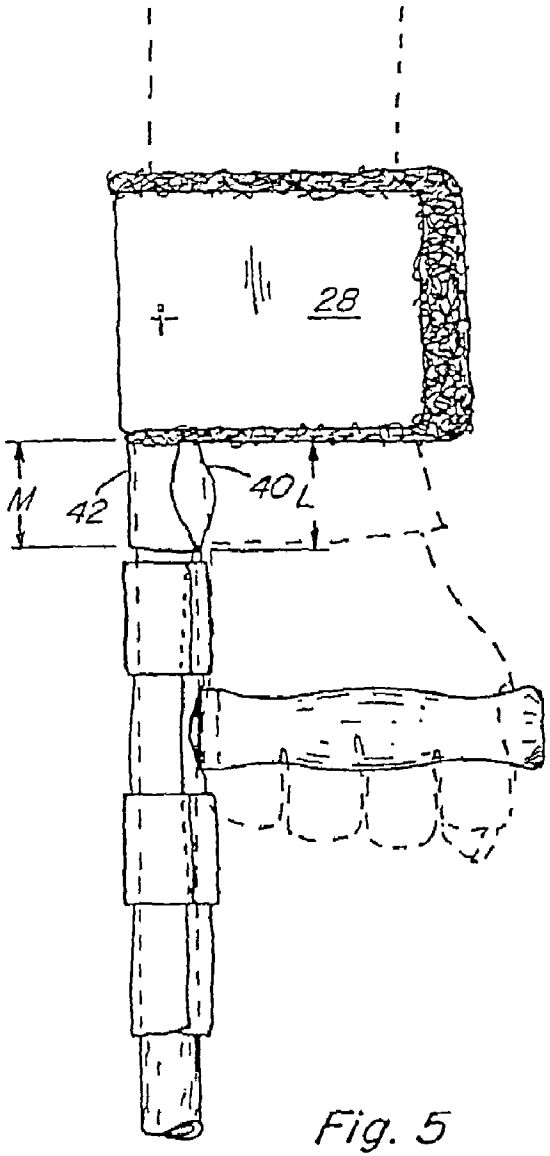
FIG. 5 is a side view of a preferred embodiment of the invention as shown on a forearm crutch with the forearm cradle rotated forward, or in a weight bearing position typically associated with walking.

The front and back pole portions 30, 36 may have an expandable portion 40, 42 at or near their connection to the front and rear cradle portions 26, 28 to provide for the increase in length that may be required in the front and back pole portions 30, 36 as the forearm cradle 14 is rotated about axis A through its range of positions. FIGS. 5 and 6 show the increase in length that may be required of the expandable portions 40, 42 when the forearm cradle 14 is rotated from a forward position as shown in FIG. 5, around axis A, to a more backward position as shown in FIG. 6. In FIG. 5, when the forearm cradle is in its generally forward or weight bearing position associated with using the forearm crutch to walk, the expandable portion 40 is shown to have length L, and the expandable portion 42 is shown to have length M. In FIG. 6, when the forearm cradle is in its generally backward or hands free position associated with using the forearm crutch at rest, the expandable portion 40 is shown to have length X+L, and the expandable portion 42 is shown to have length Y+M to accommodate the increased length that may be required in the front and back pole portions 30, 36. In addition, because the typical forearm crutch is adjustable for users of various heights and arm lengths, the expandable portions 40, 42 may allow the same forearm crutch cover 10 to fit a forearm crutch at a variety of adjusted sizes.

The forearm crutch cover 10 may be made entirely of soft, flexible natural or man-made material. The use of an expandable portion 40, 42, however, allows for more freedom in selecting the material that may be used for the cover 10. With the exception of the padding for the front cradle portion 26, the forearm crutch cover 10 may be made of a harder, more durable material such as plastic, vinyl, metal or the like, or a combination of hard and soft materials, provided an expandable portion is used at some location along the forearm crutch cover 10 to allow for movement of the forearm cradle 14.

The advantage of having an expandable portion, as at 40, along the front or inside part of the crutch, below its cradle, is that furnishing and expandable portion at this location allows for the cradle to be biased back into its aligned position, ready for usage, in the event that the cradle may have been tilted or pivoted rearwardly, during usage. Thus, the use of an expandable portion at this location helps maintain the forearm crutch in proper alignment, ready for usage, whenever it is applied.

Another alternative for this invention includes a forearm crutch or cane having a forearm cradle constructed with a padded material attached to the inside of the forearm cradle. The invention could further include one or more pole portions covering at least part of the pivoting attachment junction of the forearm cradle and the pole.

Figure 7:
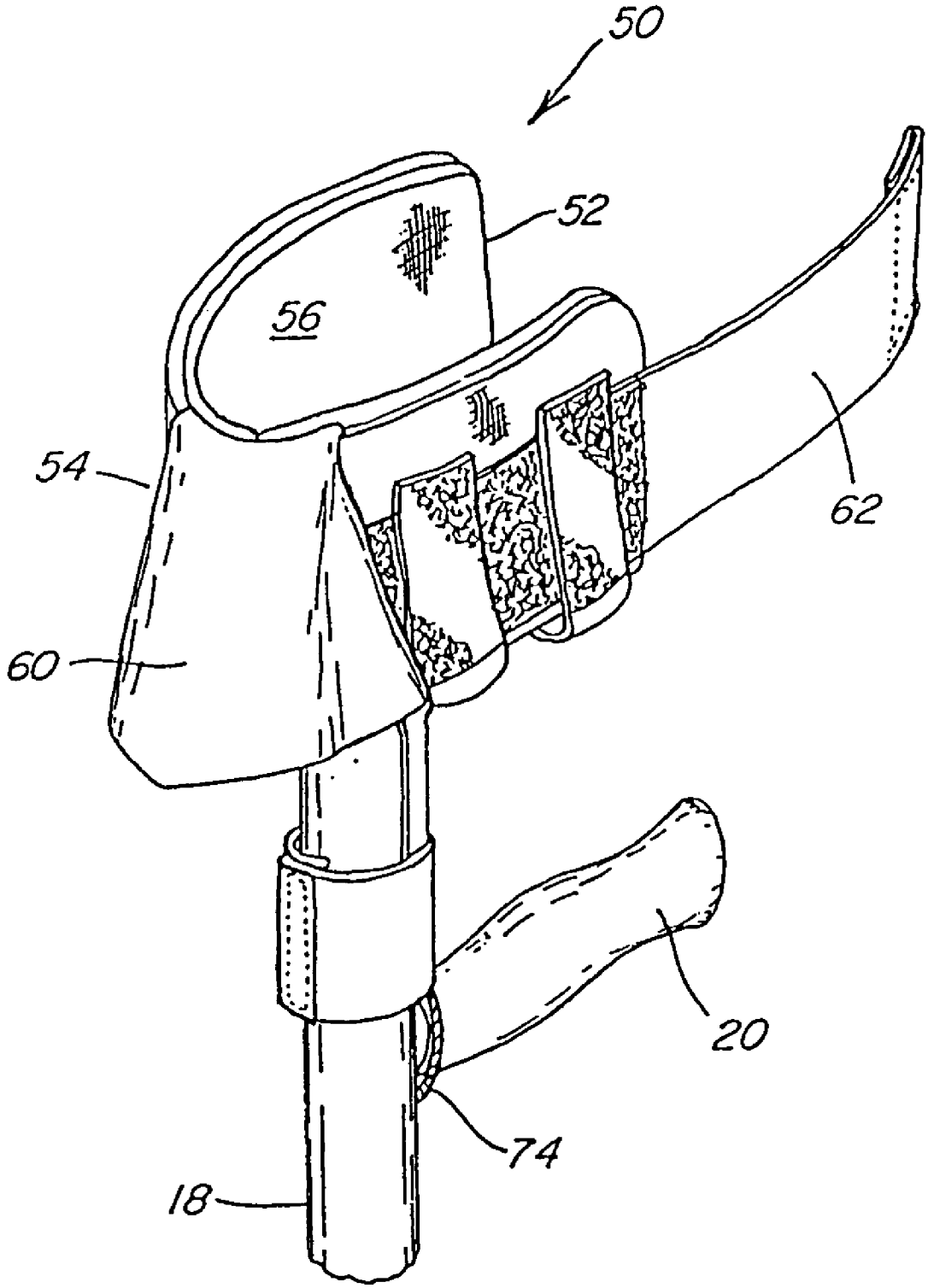
FIG. 7 is a perspective view of another preferred embodiment of the forearm crutch cover as used on a forearm crutch.

A second preferred embodiment of the forearm crutch cover is shown in FIG. 7. In this embodiment, cover 50 for a forearm cane or a forearm crutch as shown on a forearm crutch of in FIG. 1 having forearm cradle 14, pole 18 and handgrip 20. Pivoting attachment 16 of forearm cradle 14 to pole 18 is shown in the encircled portion of FIG. 1 without cover 50. Again, pivoting connection 16, shown as a yoke and bolt attachment in this embodiment, could be a collar and pin joint, a hinge, a swivel, a ball and socket assembly, or the like, depending upon the particular design and construction of the forearm cane or crutch. Pivoting connection 16 allows forearm cradle 14 to rotate about axis A through a range of positions. When utilized, cover 50 may fit over forearm cradle 14 and may cover at least a portion of yoke and bolt attachment 16 that pivotally attaches forearm cradle 14 to pole 18. The front 52 of cover 50 may be situated inside forearm cradle 14 and may extend down pole 18 towards sidewardly extending handgrip 20. The back 54 of cover 50 may be situated around the back or outside of forearm cradle 14 and may extend down pole 18 and may cover at least a portion of yoke and bolt attachment 16 that attaches forearm cradle 14 to pole 18. In this embodiment, cover 50 is made from a flexible or nonflexible material that envelopes forearm cradle 14. The back of 54 of cover 50 may include pleat 60, which may be expandable to cover attachment 16 of forearm cradle 14 to pole 18. This embodiment also includes optional safety strap 62 that covers the forearm when inside forearm cradle 14. Safety strap 62 may be attached to the back 54 of cover 50 by hook and loop, or any suitable attachment method as described above. When the forearm crutch is used with cover 50, the user positions safety strap 62 across the forearm, enclosing the U-shaped or C-shaped forearm cradle 14. When the user releases handgrip 20, safety strap 62 may allow the forearm crutch to hang or dangle from the user's arm and may prevent the forearm crutch from falling to the ground.

Figure 8:
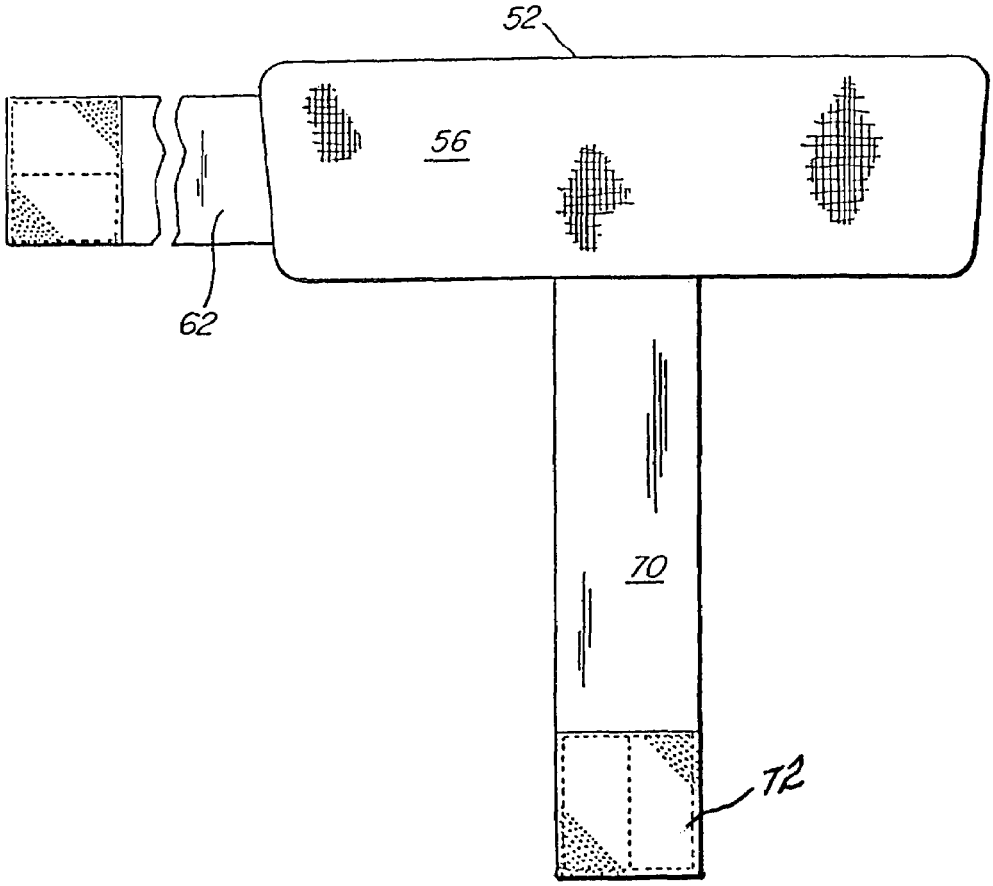
FIG. 8 is a plan view of the preferred embodiment of the forearm crutch cover of FIG. 7 as seen from the front.
Figure 9:
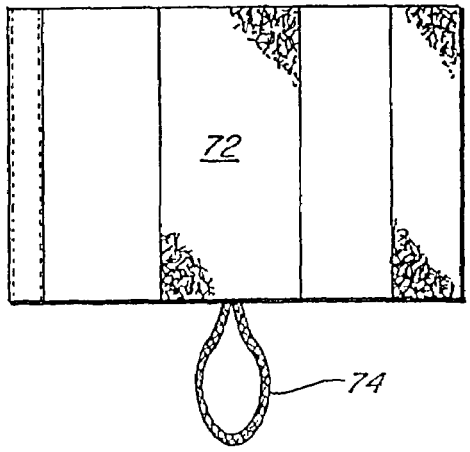
FIG. 9 is a plan view of the preferred embodiment of the forearm crutch cover of FIG. 7 as seen from the front with the optional removable handgrip attachment.

FIGS. 8 and 9 show an embodiment for the front 52 of forearm crutch cover 50 including front cradle portion 56, pole extension 70, and handgrip loop portion 72, Front cradle portion 56 of cover 50 is situated inside forearm cradle 14 and comes directly in contact with the user's arm. Front cradle portion 56 may be padded with a breathable padding and made of non-allergenic material for the comfort of the user. Front cradle portion 56 may include a breathable pad or be constructed from material that minimizes or helps eliminate perspiration. Suggested materials for the cover include, but are not limited to, 1000 denier nylon for the outside and COOLMAX® for the breathable pad. As an option, front cradle portion 56 may include a removable pad that can be removed and discarded or removed and washed for reuse. Pole extension 70 attaches to front cradle portion 56 and extends down pole 18 towards handgrip 20. Handgrip portion 72 includes handgrip loop 74 that may be placed around handgrip 20 as shown in FIG. 7 to help secure cover 50 to the forearm crutch. Handgrip loop portion 72 may include hook and loop attachment system, or some other suitable attachment system, to pole extension 70. Pole extension 70 may be constructed of a stretchable or nonstretchable material such as elastic, or it may include a stretchable portion to accommodate the variation of lengths of poles 18 and to allow forearm cradle 14 to rotate through its range of positions as described hereinabove in a discussion of FIGS. 5 and 6. Handgrip loop portion 72 may also adjust the length of pole extension 70. As previously reviewed, the pole extension 70 may include a resilient portion, that continuously biases the cradle into proper alignment upon the forearm crutch, and to maintain it prepared for ready usage when applied. In other words, the user need not be continuously pivoting the cradle into a usable position, every time he/she wishes to make use of the same. Increasing and decreasing the amount of overlap between handgrip loop portion 72 and pole extension 70, may allow cover 50 to be used with varying pole 18 lengths.

Figure 10:
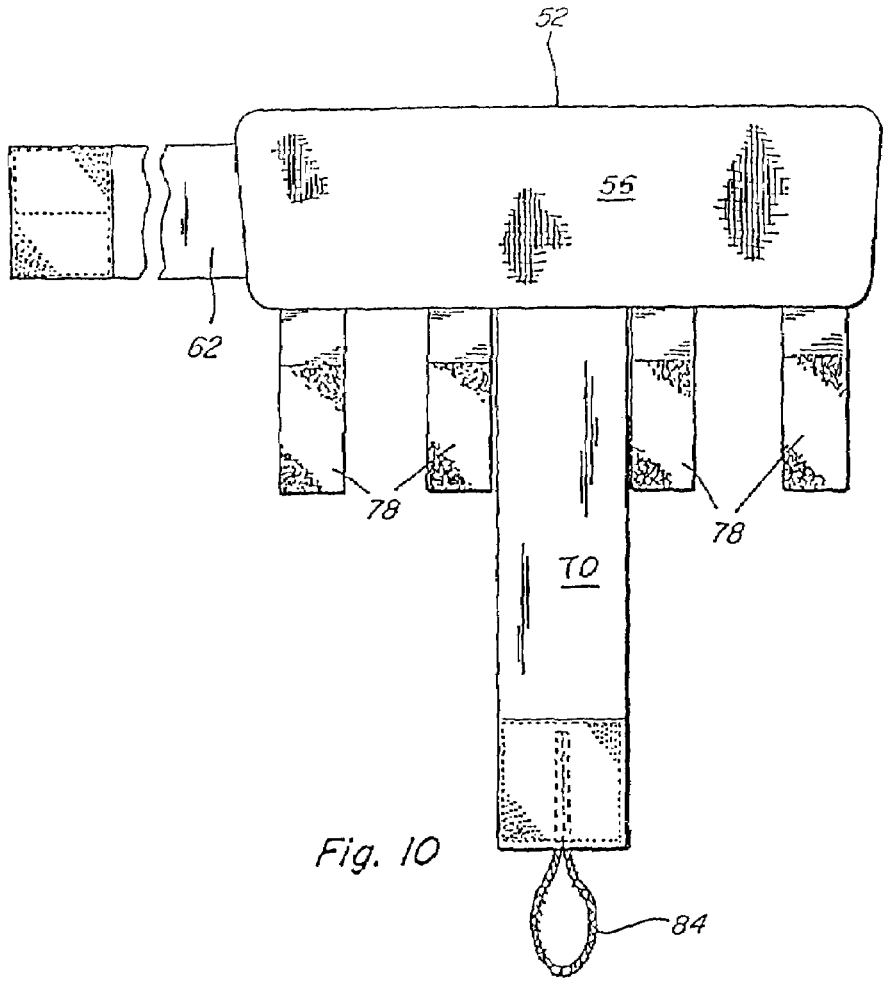
FIG. 10 is a plan view of the removable handgrip attachment for use with the forearm crutch cover of FIG. 9.

FIG. 10 depicts an option to the embodiment of cover 50 shown in FIG. 7. In this option handgrip loop portion 72 is basically eliminated and handgrip loop 84 is attached directly to pole extension 70. Pole extension 70 attaches to front cradle portion 56 and extends down pole 18 and attaches to handgrip 20 using handgrip loop 84 that may be placed around handgrip 20. Another option shown in FIG. 10 includes the use of hook and loop straps 78 or any suitable attachment method as described above to secure front cradle portion 56 to forearm cradle 14.

During normal operation, without forearm crutch cover 10, forearm cradle 14 can pivot from its forward position desired during use by the user to a backwards position. When pivoted backwards, the user must first rotate forearm cradle 14 forward while balancing without the use of the crutch before placing an arm inside forearm cradle 14 for use. When forearm crutch cover 10 is attached to the forearm crutch with pole extension 70 engaging handgrip 20 by either option depicted in FIGS. 8 to 10, cover 10 may help maintain forearm cradle 14 in a relative forward position. Therefore pole extension 70 may act as a forearm cradle 14 reset by resisting the tendency of forearm cradle 14 to fall backward out of the desired position of the forearm crutch user. Thus the need to find a place to balance while readying the forearm crutch for use may be minimized or eliminated.

Figure 11:
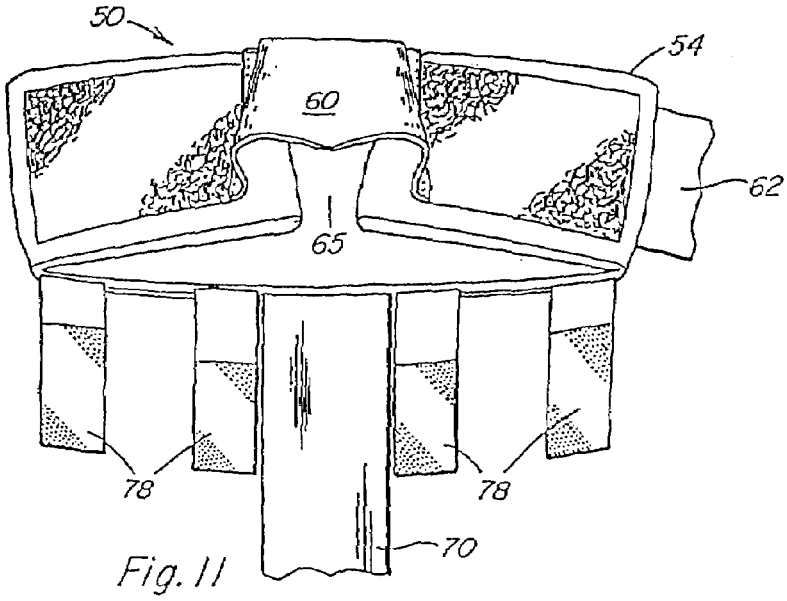
FIG. 11 is a rear elevated view of the preferred embodiment of the forearm crutch cover of FIG. 7.

FIG. 11 depicts the back 54 of cover 50 shown in FIG. 7. Forearm cradle 14 fits inside 65 cover 50, and hinged attachment 16 of forearm cradle 14 to pole 18 sits under or inside pleat 60. Pleat 60 may be made of a durable material that generally holds its shape as described above. Pleat 60 may include a portion sized to enclosed is most or all of attachment 16.

This description does not intend to limit the performance of these processes and functions to only the methods described herein. Many processes can be performed in a different, but equivalent manner or order than described herein without exceeding the scope of this invention.

Although the invention has been described in terms of specific embodiments and applications, persons skilled in the art can, in light of this teaching, generate additional embodiments without exceeding the scope or departing from the spirit of the claimed invention. In addition, specific features of the invention are shown in some drawings and not in others for convenience only, as each feature may be combined with any or all of the other features in accordance with the invention. Accordingly, it is to be understood that the drawings and description in this disclosure are proffered to facilitate comprehension of the invention and should not be construed to limit the scope thereof.

We claim:

1. A forearm crutch padded cover for covering the forearm cradle of a forearm crutch having a top portion of an elongate crutch pole being pivotally attached to a substantial center portion of an outer part of the forearm cradle via a pivotal connection, and a forwardly extending hand grip mounted on the pole, comprising: a cover member, said cover member including a front portion and a back portion, said front portion adapted to cover an inside of the forearm cradle, and the back portion adapted to cover the outer part of the forearm cradle and the pivotal connection between the forearm cradle and the pole such that the forearm cradle is substantially covered by the cover member, a pole engaging portion connecting with and extending downwardly from an substantial center portion of the front portion of the cradle cover member, the pole engaging portion extending downwardly in proximity with a part of the length of the pole, at least one first engaging element connecting to a downward segment of the downwardly extending pole engaging portion and extending outward for wrapping around the contiguous pole and the pole engaging portion and fastening onto itself to secure the padded cover to the forearm crutch, an enclosing member sized and cooperatively attached to said cover member and provided for enclosing the forearm cradle and retaining the forearm of any user of said forearm crutch, whereby said padded cover covers the forearm cradle, its pivotal connection with the elongate pole, and a portion of the pole during usage.

2. The forearm crutch cover of claim 1 wherein a portion of said cover member includes an expandable section whereby movement of the forearm cradle relative to the pole causes said expandable section to expand.

3. The forearm crutch cover of claim 1 wherein said cover member is padded on at least some portion thereof.

4. The forearm crutch cover of claim 3 wherein the front portion of the cover is padded.

5. The forearm crutch cover of claim 3 wherein said cover member includes a detachable padded portion.

6. The forearm crutch cover of claim 1 wherein said cover is made of flexible material.

7. The forearm crutch cover of claim 1 wherein said cover is made of non-allergenic material.

8. The forearm crutch cover of claim 1 wherein said pole engaging portion includes an enclosure attached to the handgrip to secure said pole engaging portion to the forearm crutch.

9. The forearm crutch cover of claim 1 wherein said cover member includes a pleated portion covering the pivotal attachment of the forearm cradle and the pole.

10. The forearm crutch of claim 4 wherein said padded member is formed of a fur like material.

11. The forearm crutch padded cover of claim 4 wherein said padded cover member is formed of a cloth like material.

12. The forearm crutch cover of claim 1 wherein said cover member includes a pleated portion covering at least a portion of the pivotal attachment of the forearm cradle to the pole.

13. The forearm crutch cover of claim 1 wherein said pole engaging portion includes a stretchable portion.

14. The forearm crutch cover of claim 1 wherein said pole engaging portion is adjustable in length.

15. The forearm crutch cover of claim 1 wherein said element for securing said cover member and said pole engaging portion to the forearm crutch includes hook and loop fastening tabs cooperatively engaged around the pole.

16. The forearm crutch cover of claim 1 wherein said element for securing said cover member and said pole engaging portion to the forearm crutch includes a loop cooperatively engaged around the handgrip.

17. The forearm crutch cover of claim 1 wherein said pole engaging portion includes an attachment to the handgrip.

18. The forearm crutch cover of claim 1 wherein said cover member includes a breathable pad.

19. The forearm crutch cover of claim 1 wherein said cover member includes a removeable pad.

20. The forearm crutch cover of claim 1 wherein said cover member includes a removeable, washable, and reusable pad.

21. The forearm crutch cover of claim 1 wherein said cover member is made of 100 denier nylon and includes a COOLMAX® pad.

22. The forearm crutch cover of claim 1 wherein said enclosing member comprising a safety strap.

23. The forearm crutch cover of claim 1 and including at least one strap securing to the cover and extending under the forearm cradle to secure the cover to said cradle.

24. The forearm crutch cover of claim 23 wherein there are four straps securing the cover to the forearm cradle.

25. The forearm crutch cover of claim 23 wherein the strap adjustability mounts the safety strap to the cover.

* * * * *